US006179585B1

(12) United States Patent
Kobylinski et al.

(10) Patent No.: US 6,179,585 B1
(45) Date of Patent: Jan. 30, 2001

(54) MODULAR PLUG CONNECTOR FOR USE WITH A SUBMERGIBLE PUMPING SYSTEM

(75) Inventors: Lee S. Kobylinski; Kevin T. Scarsdale, both of Bartlesville, OK (US)

(73) Assignee: Camco International, Inc., Houston, TX (US)

( * ) Notice: Under 35 U.S.C. 154(b), the term of this patent shall be extended for 0 days.

(21) Appl. No.: 09/138,986

(22) Filed: Aug. 24, 1998

(51) Int. Cl.[7] ..... F04B 17/00; F04B 35/04

(52) U.S. Cl. ..... 417/423.3; 417/423.15; 166/65.1

(58) Field of Search ..... 417/423.3, 423.15, 417/424.2, 425; 166/65.1, 66.4, 72, 73, 77

(56) References Cited

U.S. PATENT DOCUMENTS

| | | | | |
|---|---|---|---|---|
| 3,835,929 | * | 9/1974 | Suman, Jr. | 166/315 |
| 4,627,490 | | 12/1986 | Moore | 166/65.1 |
| 4,913,239 | | 4/1990 | Bayh, III | 166/385 |
| 5,058,683 | | 10/1991 | Godfrey et al. | 166/381 |
| 5,070,940 | | 12/1991 | Conner et al. | 166/65.1 |
| 5,145,007 | | 9/1992 | Dinkins | 166/386 |
| 5,146,982 | * | 9/1992 | Dinkins | 166/65.1 |
| 5,269,377 | * | 12/1993 | Martin | 165/385 |
| 5,334,801 | * | 8/1994 | Mohn | 174/47 |
| 5,348,097 | | 9/1994 | Giannesini et al. | 166/385 |
| 5,370,545 | | 12/1994 | Laurent | 439/190 |
| 5,906,242 | * | 5/1999 | Bruewer et al. | 166/378 |

FOREIGN PATENT DOCUMENTS

| | | | |
|---|---|---|---|
| 2 113 484 | 8/1983 | (GB) | H01R/3/00 |
| 2 203 602 | 10/1988 | (GB) | H01R/11/01 |

* cited by examiner

*Primary Examiner*—Teresa Walberg
*Assistant Examiner*—Thor Campbell
(74) *Attorney, Agent, or Firm*—Fletcher, Yoder & Van Someren

(57) ABSTRACT

A modular plug system facilitates engagement and disengagement of the power cable with a submergible pumping system. The modular plug includes a first plug portion connected to the power cable and mounted within an upper assembly of the connector. The plug also includes a second plug portion connected by a plurality of conductors with the submergible motor. The second plug portion is mounted within a lower assembly of the connector and is configured for mating engagement with the first plug portion. The upper assembly and lower assembly of the connector also are designed for relatively easy engagement and disengagement coincident with the engagement and disengagement of the plug.

19 Claims, 5 Drawing Sheets

FIG. 7
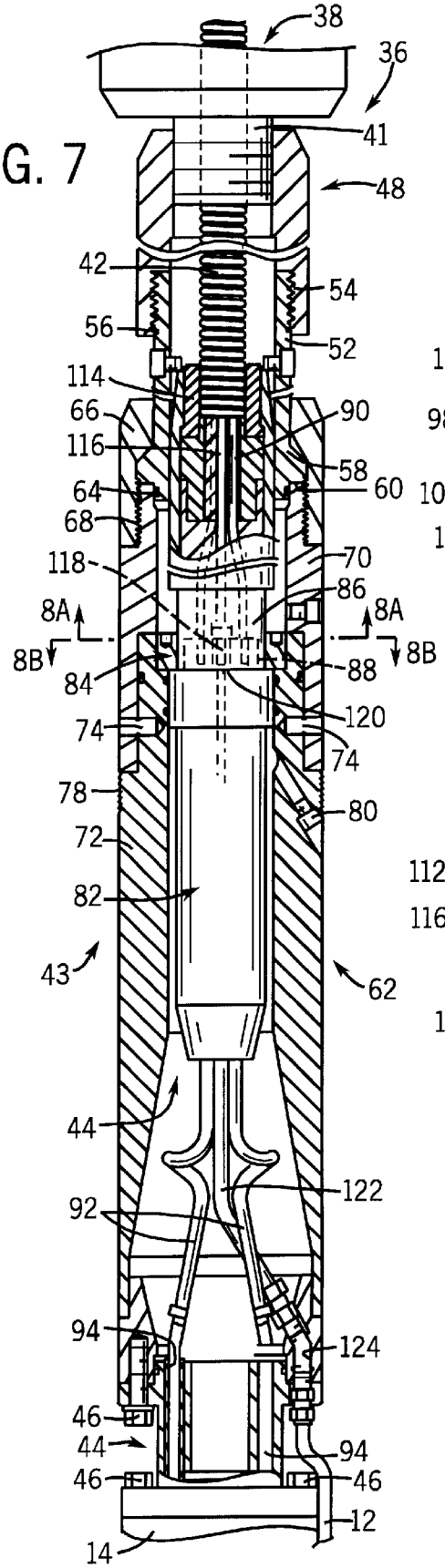
FIG. 8A
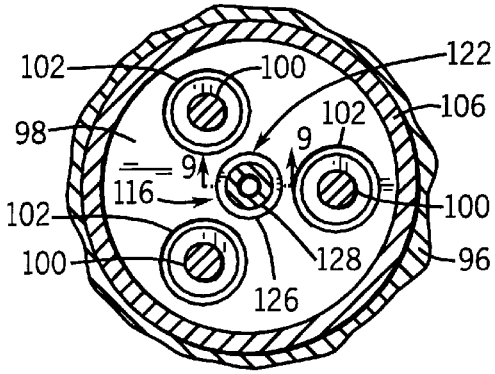
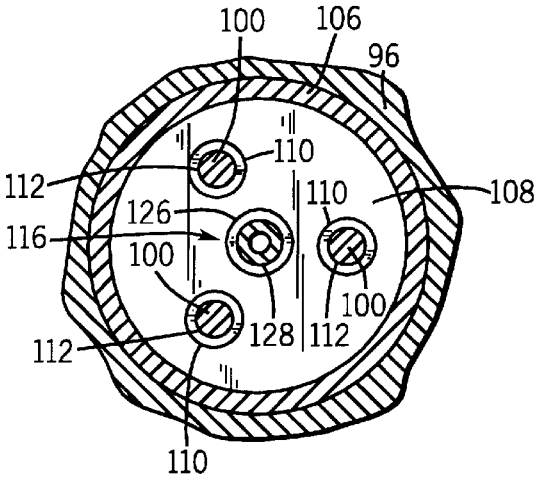
FIG. 8B

MODULAR PLUG CONNECTOR FOR USE WITH A SUBMERGIBLE PUMPING SYSTEM

FIELD OF THE INVENTION

The present invention relates generally to submergible pumping systems for raising fluids from wells and, particularly, to a selectively engageable connector for connecting a power supply cable to a submergible pumping system.

BACKGROUND OF THE INVENTION

In producing petroleum and other useful fluids from production wells, it is generally known to provide a submergible pumping system for raising the fluids collected in a well. Production fluids enter a wellbore via perforations formed in a well casing adjacent a production formation. Fluids contained in the formation collect in the wellbore and may be raised by the submergible pumping system to a collection point above the earth's surface.

In an exemplary submergible pumping system, the system includes several components, such as a submergible electric motor that supplies energy to a submergible pump. The system may further include additional components, such as a protector, for isolating the motor oil from well fluids. A connector also is used to connect the submergible pumping system to a deployment system. These and other components may be combined in the overall submergible pumping system.

Conventional submergible pumping systems are deployed within a wellbore by tubing, cable, or coiled tubing. Power is supplied to the submergible electric motor via a power cable that runs along the deployment system. For example, with coiled tubing, the power cable is either banded to the outside of the coiled tubing or disposed internally within the hollow interior formed by the coiled tubing.

Power cables typically contain conductors for powering the submergible motor. The motor conductors, typically three conductors, extend along the deployment system to the submergible pumping system where they are hardwired to the motor. The actual conductors may be routed through the connector or alongside the connector.

Regardless of the specific method used for connecting the power cable, the conductors are connected to the motor and the deployment system is attached to the connector prior to deployment of the submergible pumping system. When the conductors of the power cable are connected to the submergible pumping system, the connection point must be prepared carefully to ensure isolation from the relatively hostile environment within a wellbore. For example, if the conductors are routed into the motor, the point of entrance must be rigorously sealed from the fluids and environment in which the submergible motor is disposed. Conventional connection methods for connecting the power cable to the motor are time-consuming and can be subject to failure if careful attention is not paid to sealing any connection points from the wellbore environment.

It would be advantageous to utilize a modular system suited for easy connection of the power cable to the submergible motor or any other components requiring a control input or a communication line.

SUMMARY OF THE INVENTION

The present invention features a connector for connecting a submergible pumping system to a deployment system utilized to deploy the submergible pumping system within a wellbore. The connector is designed with a selectively engageable modular plug system that permits easy attachment of the power cable to the submergible pumping system. Specifically, the connector includes an upper assembly having a plurality of conductors disposed therein. The plurality of conductors terminates at a first plug portion. Additionally, the connector includes a lower assembly having a plurality of corresponding conductors disposed therein. The plurality of corresponding conductors terminates at a second plug portion. The first plug portion and the second plug portion are designed for mating engagement, such that the plurality of conductors form a conductive path with the plurality of corresponding conductors.

According to another aspect of the present invention, a submergible pumping system utilizes a modular connector for easy engagement and disengagement of control lines used for the submergible pumping system. The system includes a string of submergible components, including a submergible motor and a submergible pump. The submergible motor is attached to a plurality of electrical leads which terminate at a first plug portion. The system also includes a deployment system for deploying the string of submergible components. A power cable is disposed along the deployment system and includes a plurality of conductors that supply electrical power to the submergible motor. The plurality of conductors terminates at a second plug portion configured for mating engagement with the first plug portion.

According to yet another aspect of the invention, a method is provided for facilitating connection of control lines to a submergible pumping system. The method comprises connecting a plurality of electrical conductors to a submergible motor of the submergible pumping system. The method also includes providing a split in the plurality of electrical conductors proximate the submergible pumping system. A separable plug may then be attached to the plurality of electrical conductors at the split to permit selective engagement and disengagement of the plurality of electrical conductors.

BRIEF DESCRIPTION OF THE DRAWINGS

The invention will hereafter be described with reference to the accompanying drawings, wherein like reference numerals denote like elements, and:

FIG. 7 is a cross-sectional view of a connector and modular plug, according to an alternate embodiment of the present invention;

FIG. 8*a* is a cross-sectional view taken generally along line 8*a*—8*a* of FIG. 7;

FIG. 8*b* is a cross-sectional view taken generally along line 8*b*—8*b* of FIG. 7.

DETAILED DESCRIPTION OF THE PREFERRED EMBODIMENTS

Figure 1:
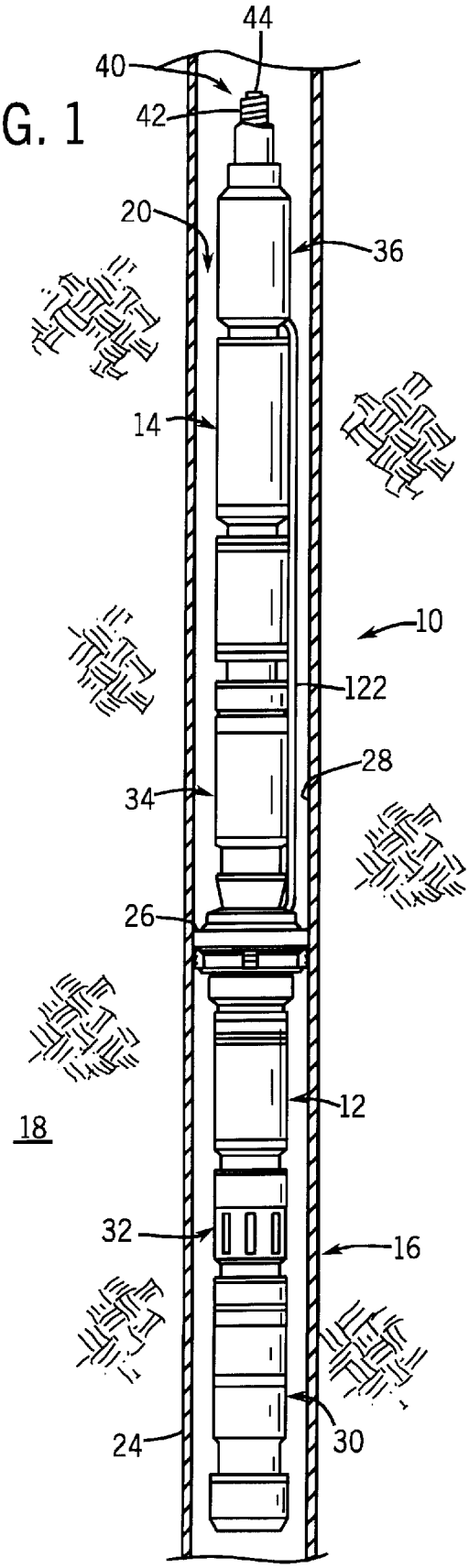
FIG. 1 is a front elevational view of a submergible pumping system positioned in a wellbore, according to a preferred embodiment of the present invention.

Referring generally to FIG. 1, a submergible pumping system 10 is illustrated according to a preferred embodiment of the present invention. Submergible pumping system 10 may comprise a variety of components depending on the particular application or environment in which it is used. However, system 10 typically includes at least a submergible pump 12 and a submergible motor 14.

System 10 is designed for deployment in a well 16 within a geological formation 18 containing desirable production fluids, such as petroleum. In a typical application, a wellbore 20 is drilled and lined with a wellbore casing 24. The submergible pumping system 10 is deployed within wellbore 20 to a desired location for pumping of wellbore fluids.

As illustrated, submergible pumping system 10 typically includes other components. For example, a packer assembly 26 may be utilized to provide a seal between the string of submergible components and an interior surface 28 of wellbore casing 24. Packer assembly 26 may be integrally combined with the string of submergible components, or it can be set in place within wellbore casing 24 before the remainder of submergible pumping system 10 is deployed in well 16. With packer assembly 26, production fluids are pumped into the annulus defined by wellbore casing 24.

Other additional components often comprise a thrust casing 30, a pump intake 32, through which wellbore fluids enter pump 12, a protector 34, that serves to isolate the well fluid from the motor oil, and a connector 36. Connector 36 is used to connect submergible motor 14 with a deployment system 38, such as tubing, cable or coil tubing. In the preferred embodiment, the deployment system is a coiled tubing system 40 utilizing a coiled tube 41 having a power cable 42 running through its hollow center, as will be described in detail below.

It should be noted that a variety of submergible pumping systems 10 can be utilized with the present invention. For example, a variety of motors 14 and pumps 12 can be used, and the production fluids pumped by pump 12 and motor 14 potentially can be pumped through the annulus or through tubing. In either event, an exemplary motor 14 is a three-phase induction-type motor, and an exemplary pump 12 is a multi-staged centrifugal pump. Additionally, other components can be added, components can be removed, or the sequence of components can be rearranged according to the desired application.

Figure 2:
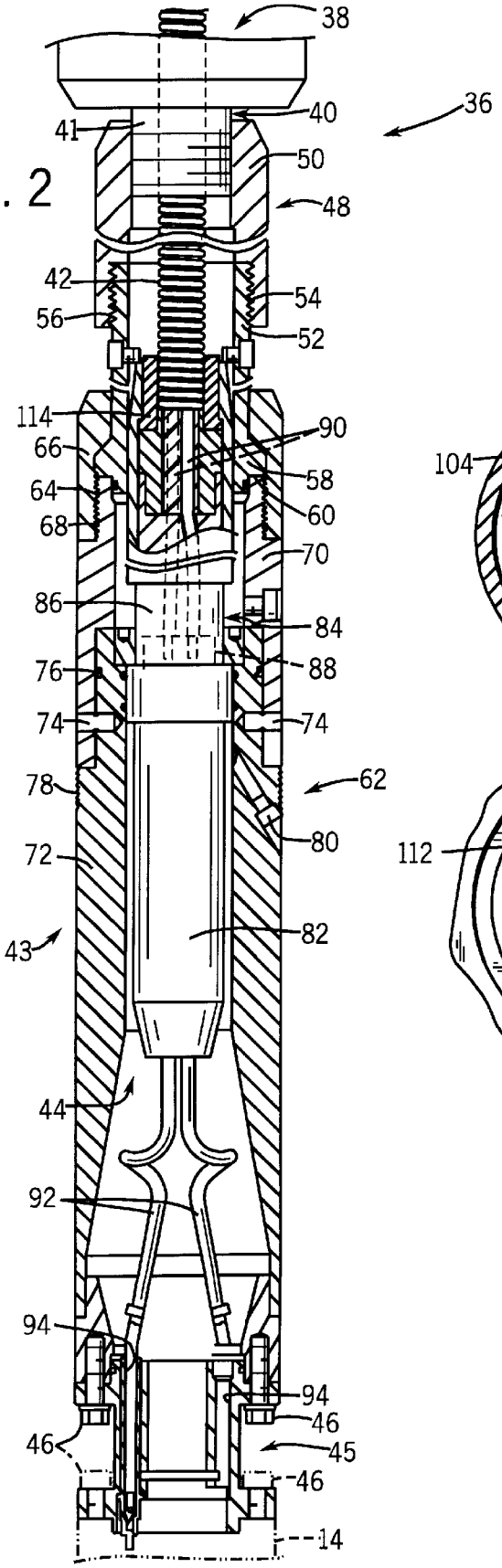
FIG. 2 is a cross-sectional view of a connector, according to a preferred embodiment of the present invention.

Referring generally to FIG. 2, a cross-sectional view of connector 36 is taken generally along a longitudinal axis of connector 36. In the preferred embodiment, connector 36 includes an outer housing 43 having an interior hollow region 44. Connector 36, and specifically housing 40, is connected to the next sequential component of submergible pumping system 10, preferably motor 14, by a mounting structure 45. Mounting structure 45 may be designed for connection to motor 14 and outer housing 43 via a plurality of fasteners 46, such as bolts.

In the illustrated embodiment, connector 36 includes an upper assembly 48 that engages deployment system 38. In the illustrated embodiment, upper assembly 48 is connected to coiled tubing 41. Upper assembly 48 includes a head connector 50 engaged with a housing connector 52 via a threaded region 54 and a sealing ring 56. Housing connector 52 further includes a radially, outwardly extending flange 58 that declines a notched portion 60. Notched portion 60 abuts against a lower assembly 62. A seal 64 is disposed between the upper assembly 48 and lower assembly 62 of outer housing 43. Additionally, upper assembly 48 and lower assembly 62 preferably are selectively connected by a fastener, such as a union 66. Union 66 is designed to engage flange 58 of upper assembly 48 and threadably engage a threaded portion 68 of lower assembly 62.

Lower assembly 62 includes a collar connector 70 having threaded portion 68 disposed along its upper end. Collar connector 70 is engaged with a lower housing connector 72 by a plurality of shear pins 74 and sealed thereto by a seal ring 76. Thus, if submergible pumping system 10 becomes stuck within wellbore 20, upper assembly 48 and collar connector 70 may be sheared away from lower housing connector 72. Lower housing connector 72 may include a plurality of fishing teeth 78 to permit later retrieval of the remainder of submergible pumping system 10 if upper assembly 48 and collar connector are sheared away.

Lower assembly 62 also includes a drain 80 for draining fluids, as necessary, from interior hollow region 44 to wellbore 20. Drain 80 may have a variety of designs and may be disposed at other locations in outer housing 43.

With further reference to FIGS. 3–6, a primary aspect of the present invention will be explained more fully. Upper assembly 48 and lower assembly 62 may have a variety of configurations, but each configuration preferably includes a modular plugging system to permit power cable 42 to be readily connected to submergible motor 14 and potentially other components in submergible pumping system 10.

In the preferred embodiment, connector 36 includes a penetrator 82 disposed within hollow region 44 of outer housing 43. Penetrator 82 includes a separable plug 84 (see FIGS. 3 and 4). Plug 84 includes a first plug portion 86 that is mounted in upper assembly 48. Furthermore, plug 84 includes a second plug portion 88 mounted in lower assembly 62.

A plurality of conductors 90, from power cable 44, extend into and are disposed within upper assembly 48. Conductors 90 terminate in first plug portion 86. Typically, conductors 90 comprise three conductors for supplying power to motor 14. Similarly, a plurality of conductors 92, sometimes referred to as electrical leads, extend into and are disposed in lower assembly 62. Conductors 92 terminate at second plug portion 88. Conductors 92 preferably are prewired or preattached to submergible motor 14. This permits power cable 44 to be connected to submergible motor 14 simply by engaging first plug portion 86 with second plug portion 88 prior to deployment of submergible pumping system 10 in wellbore 20. (See FIG. 3). Similarly, the conductive path may be split by separating first plug portion 86 from second plug portion 88. (See FIG. 4).

Conductors 92 typically comprise three conductors that may be hardwired to submergible electric motor 14 in a variety of ways known to those of ordinary skill in the art. Preferably, however, conductors 92 are routed through corresponding openings 94 disposed in mounting structure 45 and then connected to submergible motor 14.

Figure 5:
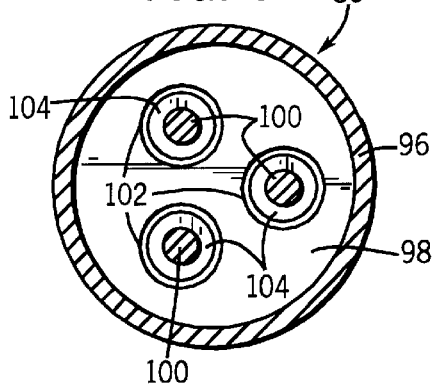
FIG. 5 is a cross-sectional view taken generally along line 5–5 of FIG. 4.
Figure 6:
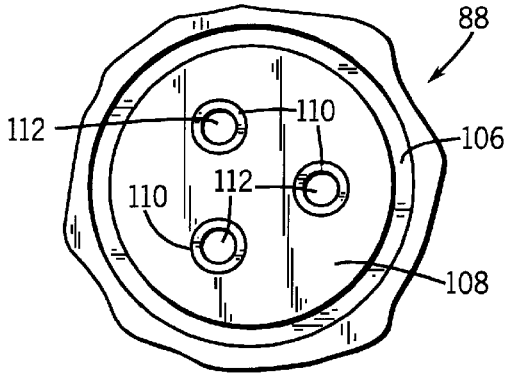
FIG. 6 is a cross-sectional view taken generally along line 6—6 of FIG. 4.
Figure 3:
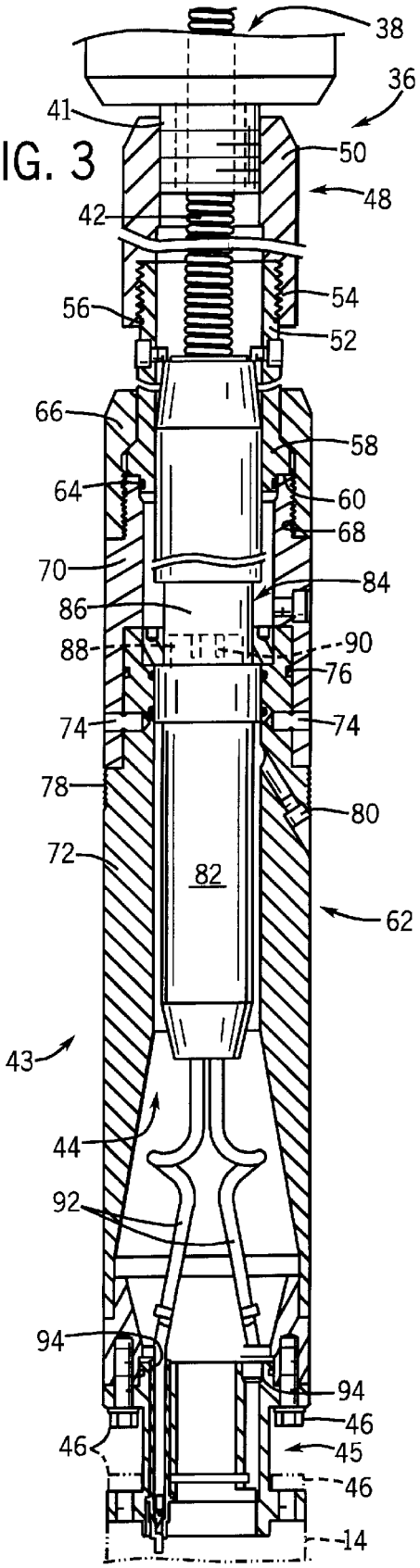
FIG. 3 is a cross-sectional view of a connector and engaged modular plug, according to a preferred embodiment of the present invention.
Figure 4:
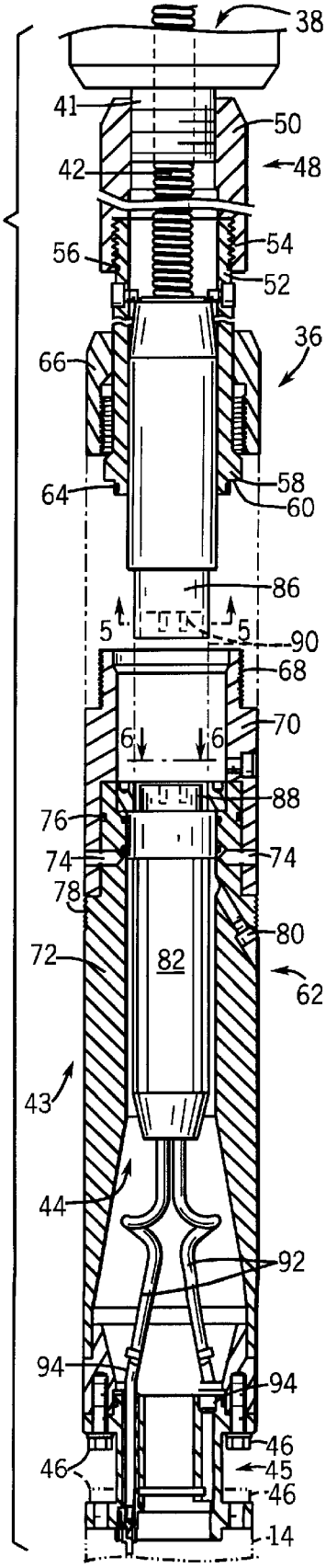
FIG. 4 is a cross-sectional view of a connector and disengaged modular plug, according to a preferred embodiment of the present invention.

Plug 84 may be designed in a variety of configurations, however, one exemplary configuration is illustrated best in the cross-sectional views of FIGS. 5 and 6. In this configuration, first plug portion 86 includes an outer circular wall 96 that extends axially from a transverse wall 98. A plurality of conductive terminal ends 100, corresponding with and connected to conductors 90, extend through transverse wall 98. Preferably, an annular terminal end housing 102 also extends from transverse wall 98 about each conductive terminal end 100 for at least a portion of the length of the corresponding terminal end. Thus, an annulus 104 is formed between each terminal end 100 and its corresponding terminal housing wall 102.

Second plug portion 88 also includes an outer circular wall 106 sized to slidingly engage circular wall 96. For example, the outside diameter of outer circular wall 106 may be slightly less than the inside diameter of circular wall 96 to permit circular wall 106 to be slid within outer circular wall 96 when first plug portion 86 and second plug portion 88 are engaged. Fluid seals, such as o-ring seals, can be disposed between outer circular walls 96 and 106 to secure a liquid-tight seal.

Second plug portion 88 further includes a transverse wall 108 from which a plurality of conductive terminal receptacles 110 extend. Each conductive terminal receptacle 110 includes an inner opening 112 sized to slidingly receive conductive terminal ends 100 such that a conductive path is formed from conductive terminal ends 100 to conductive terminal receptacles 110. As illustrated, conductive terminal ends 100 are connected with conductors 90 and conductive terminal receptacles 110 are connected with conductors 92 so as to provide appropriate conductive paths from power cable 42 to submergible motor 14 when first plug portion 86 is engaged with second plug portion 88. Preferably, conductive terminal receptacles 110 are circular in cross-section and sized for reception within the annulus 104 formed between conductive terminal ends 100 and terminal housing walls 102 of first plug portion 86.

Although the illustrated plug 84 is a preferred embodiment of the invention, a variety of plug configurations could be utilized while still maintaining the modular aspect of a ready-wired plug connection for connecting a power cable to a submergible electrical motor prior to deployment. In the embodiment illustrated, a power cable extending through the center of coiled tubing 41 is securely mounted in upper assembly 48 by an appropriate mounting structure 114 such that conductors 90 may be coupled with first plug portion 86. Similarly, lower assembly 62 is prewired to submergible electric motor 14 and/or other components within submergible pumping system 10. Prior to deployment, first plug portion 86 is matingly engaged with second plug portion 88 to form a continuous conductive path from conductors 90 to conductors 92.

After engaging first plug portion 86 and second plug portion 88, connector 36 may be firmly coupled together by connecting upper assembly 48 to lower assembly 62 via union 66. Similarly, when submergible pumping system 10 is retrieved from wellbore 20, the deployment system is easily disconnected from submergible pumping system 10. Union 66 simply is unscrewed to permit separation of upper assembly 48 and lower assembly 62, and thereby separation of first plug portion 86 from second plug portion 88.

Figure 9:
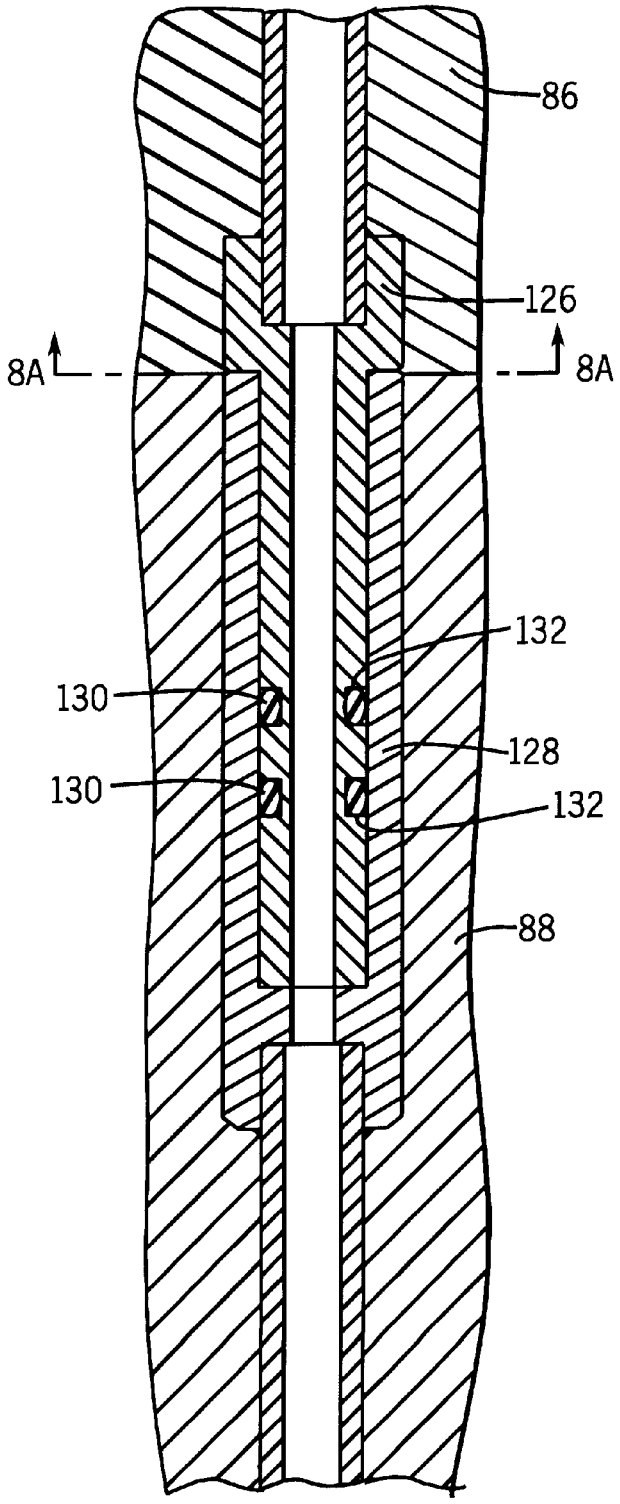
FIG. 9 is a cross-sectional view taken generally along line 9—9 of FIG. 8*a*.

As illustrated in FIGS. 7–9, plug 84 can be utilized for facilitating engagement and disengagement of control lines other than the plurality of motor conductors 90, 92. An additional control line 116 may be disposed through plug 84. Control line 116 may comprise one or more of a variety of a control lines, including electrical conductors, optical fibers, and fluid conductors. In any of these implementations, control line 116 is engageable and disengageable at plug portion 84. For example, control line 116 may have a male portion 118 extending from transverse wall 98 of first plug portion 86 and a female receptacle 120 disposed through transverse wall 108 of second plug portion 88. Thus, control line 116 may be engaged and disengaged simultaneously with conductors 90 and 92 when plug 84 is engaged and disengaged.

In one preferred embodiment, control line 116 comprises a fluid flow line 122, as illustrated in FIGS. 8*a* and 8*b*. Fluid flow line 122 permits fluid, such as hydraulic fluid, to be directed through connector 36 to another component within submergible pumping system 10. For example, fluid flow line 122 may be routed through plug 84 and connector 36 until it is routed out of connector 36 via an opening 124. In this particular embodiment, control line 122 is routed along the outside of submergible pumping system 10 to a desired component, such as packer assembly 26. (See FIG. 1). In the particular exemplary embodiment, packer assembly 26 is an integral part of submergible pumping system 10 and connected in line with the other components. Fluid control line 122 allows packer assembly to be set at selected locations along the wellbore when submergible pumping system 10 is deployed.

One exemplary way of preparing a connection point for fluid flow line 122 at plug 84 is illustrated best in FIG. 9. In this adaptation, fluid flow line 122 utilizes a bayonet-style connector. Specifically, control line 116, e.g. fluid flow line 122, extends into first plug portion 86 and is sealed to a male adapter 126. Similarly, fluid flow line 122 extends from the lower side into second plug portion 88 where it is connected to a female adapter 128 that is sized to receive male adapter 126. Additionally, a pair of seals 130, such as o-ring seals, are disposed within corresponding grooves 132 formed around male adapter 126. Seals 130 provide a strong fluid seal between male adapter 126 and female adapter 128 to prevent any leakage of fluid even under substantial pressure.

It will be understood that the foregoing description is of preferred embodiments of this invention, and that the invention is not limited to the specific form shown. For example, a variety of connector components can be used in constructing the connector; one or more control lines can be added in addition to the motor conductors; a variety of control lines, such as fluid control lines, optical fibers, and conductive control lines can be adapted for engagement and disengagement at the plug; the fluid control line can be adapted for delivering fluids, such as corrosion inhibitors etc., to the various components of the submergible pumping system; and the power cable can be routed through coiled tubing or connected along the coiled tubing or other deployment systems. These and other modifications may be made in the design and arrangement of the elements without departing from the scope of the invention as expressed in the appended claims.

What is claimed:

1. A connector for connecting a submergible pumping system to a deployment system utilized to deploy the submergible pumping system within a wellbore, comprising:

an upper assembly having a first plug portion, the upper assembly being coupleable to a coiled tubing deployment system having a plurality of conductors disposed therein, the plurality of conductors being electrically coupleable to the first plug portion; and a lower assembly coupleable to a submergible pumping system and to the upper assemble, the lower assembly having a plurality of corresponding conductors disposed therein, the plurality of corresponding conductors being electrically coupleable to the second plug portion, wherein the first plug portion and the second plug portion are designed for mating engagement such that the plurality of conductors form a conductive path with the plurality of corresponding conductors.

2. The connector as recited in claim 1, wherein the plurality of corresponding conductors comprise motor conductors for connection to a submergible motor within the submergible pumping system.

3. The connector as recited in claim 2, wherein the plurality of conductors are three conductors and the plurality of corresponding conductors are three corresponding conductors that contact the three conductors when the first plug portion is engaged with the second plug portion.

4. The connector as recited in claim 3, further comprising a conductive control line that extends through the first plug portion and the second plug portion, the conductive control line including a first mating portion disposed in the first plug portion and a second mating portion disposed in the second plug portion to permit separation of the conductive control line when the first plug portion and the second plug portion are disengaged.

5. The connector as recited in claim 1, wherein the upper assembly and the lower assembly are selectively attached to one another by a threaded union.

6. The connector as recited in claim 1, further comprising a fluid line for conducting fluid, wherein the first plug portion includes a first fluid line end and the second plug portion includes a second fluid line end configured to engage the first fluid line end when the first and the second plug portions are engaged.

7. A submergible pumping system utilizing a modular connector for easy engagement and disengagement, comprising:

a modular connector assembly having a first connector with a first plug portion and a second connector with a second plug portion, the first connector and second connector being selectively detachable, the first plug portion and second plug portion being configured for mating engagement;

a string of submergible components, including a submergible motor and a submergible pump, secured to the first connector, the submergible motor being electrically coupled to the first plug portion;

a deployment system secured to the second connector for deploying the string of submergible components; and a power cable for supplying electrical power to the submergible motor, the power cable being electrically coupled to the second plug portion, wherein the plurality of electrical leads of the submergible motor are electrically coupled to the plurality of electrical conductors of the power cable when the first plug portion and second plug portion are matingly engaged, and the string of submergible components is secured to the deployment system when the first connector and the second connector are attached.

8. The submergible pumping system as recited in claim 7, wherein the deployment system comprises coiled tubing and the power cable is disposed through a hollow interior of the coiled tubing.

9. The submergible pumping system as recited in claim 8, wherein the coiled tubing is attached to the second connector of the modular connector assembly and the plurality of conductors extend through the second connector to the second plug portion.

10. The submergible pumping system as recited in claim 9, wherein the plurality of electrical leads extends through the first connector of the modular connector assembly to the first plug portion.

11. The submergible pumping system as recited in claim 10, wherein the first connector is connectable to the second connector by a union to hold the first plug portion in engagement with the second plug portion.

12. The submergible pumping system as recited in claim 7, further comprising a hydraulic control line extending through the first plug portion and the second plug portion.

13. The submergible pumping system as recited in claim 12, wherein the hydraulic control line includes a connector that allows the hydraulic control line to be connected and disconnected as the first plug portion is engaged and disengaged, respectively, with the second plug portion.

14. The submergible pumping system as recited in claim 7, further comprising an electrical control line extending through the first plug portion and the second plug portion, the electrical control line being disconnected when the first and the second plug portions are disengaged.

15. A method for facilitating connection of control lines to a submergible pumping system, comprising:

connecting a plurality of electrical conductors to a submergible motor of the submergible pumping system;

providing a split in the plurality of electrical conductors proximate the submergible pumping system;

attaching a separable plug to the plurality of electrical conductors at the split to permit selective engagement and disengagement of the plurality of electrical conductors; and connecting the submergible pumping system to a deployment system by a connector and disposing the separable plug within the connector.

16. The method as recited in claim 15, further comprising the step of disposing the separable plug within the submergible pumping system.

17. The method as recited in claim 15, further comprising the steps of disposing a first plug portion in a lower assembly of the connector; disposing a second plug portion in an upper assembly of the connector; and connecting the lower assembly to the upper assembly by a union.

18. The method as recited in claim 17, wherein the step of connecting the submergible pumping system to a deployment system includes utilizing a coiled tubing in which a power cable extends through a hollow interim of the coiled tubing into the connector.

19. The method as recited in claim 18, further comprising the step of connecting a fluid control line to the submergible pumping system through a separable fluid control line connector disposed in the separable plug.

* * * * *